US008879960B2

(12) United States Patent
Doshida

(10) Patent No.: US 8,879,960 B2
(45) Date of Patent: Nov. 4, 2014

(54) IMAGE BEARING MEMBER DRIVE UNIT THAT DRIVES IMAGE BEARING MEMBER, METHOD OF CONTROLLING IMAGE BEARING MEMBER DRIVE UNIT, STORAGE MEDIUM, AND IMAGE FORMING APPARATUS

(75) Inventor: Takaaki Doshida, Moriya (JP)

(73) Assignee: Canon Kabushiki Kaisha (JP)

( * ) Notice: Subject to any disclaimer, the term of this patent is extended or adjusted under 35 U.S.C. 154(b) by 203 days.

(21) Appl. No.: 13/597,453

(22) Filed: Aug. 29, 2012

(65) Prior Publication Data

US 2013/0058683 A1 Mar. 7, 2013

(30) Foreign Application Priority Data

Sep. 5, 2011 (JP) ..... 2011-193131

(51) Int. Cl.
*G03G 15/00* (2006.01)
*G03G 15/01* (2006.01)

(52) U.S. Cl.
CPC .... *G03G 15/0189* (2013.01); *G03G 2215/0158* (2013.01); *G03G 2215/0129* (2013.01); *G03G 15/5008* (2013.01)
USPC ..... 399/167

(58) Field of Classification Search
CPC ..... G03G 15/5008; G03G 15/757; G03G 2215/00075
USPC ..... 399/167
See application file for complete search history.

(56) References Cited

U.S. PATENT DOCUMENTS

| | | | | |
|---|---|---|---|---|
| 6,008,619 | A | 12/1999 | Murase et al. | |
| 7,904,000 | B2 * | 3/2011 | Akamatsu | 399/167 |
| 8,229,325 | B2 * | 7/2012 | Iwata et al. | 399/167 |

FOREIGN PATENT DOCUMENTS

| | | | |
|---|---|---|---|
| JP | 11-027979 | A | 1/1999 |
| JP | 2003-195687 | A | 7/2003 |

* cited by examiner

*Primary Examiner* — William J Royer
(74) *Attorney, Agent, or Firm* — Rossi, Kimms & McDowell LLP

(57) ABSTRACT

An image bearing member drive unit which is capable of performing excellent follow-up of random disturbances without increasing the costs and further with reduced energy loss. The image bearing member drive unit is formed by a brushless DC motor, a rotational position detector, a rotary encoder, a drive circuit, a motor driver IC, and a controller. The rotary encoder detects a drive speed of an image bearing member driven by the brushless DC motor. Drive current for the brushless DC motor is controlled according to the detected drive speed and a target speed. When a short brake signal for braking the brushless DC motor is on, current in a direction opposite to the drive current is generated to thereby brake the brushless DC motor.

8 Claims, 13 Drawing Sheets

IMAGE BEARING MEMBER DRIVE UNIT THAT DRIVES IMAGE BEARING MEMBER, METHOD OF CONTROLLING IMAGE BEARING MEMBER DRIVE UNIT, STORAGE MEDIUM, AND IMAGE FORMING APPARATUS

BACKGROUND OF THE INVENTION

1. Field of the Invention

The present invention relates to an image forming apparatus using an electrophotographic process, such as a copying machine, a printer, a facsimile machine, or a multifunction printer integrating such devices, and more particularly to an image bearing member drive unit for driving an image bearing member provided in an image forming apparatus, such as a photosensitive drum.

2. Description of the Related Art

In general, the electrophotographic process executed by an image forming apparatus includes an image formation process, and the image formation process includes an electrostatic charging process, an image forming process, a development process, a transfer process, a cleaning process, an electrostatic charge removal process, and the like.

In the electrostatic charging process, a surface of a photosensitive drum as an image bearing member is electrostatically charged, and in the image forming process, an electrostatic latent image is formed on the photosensitive drum according to image information obtained from an external device, such as a scanner or a personal computer. In the development process, the electrostatic latent image is developed as a toner image using a developing agent, such as toner.

Then, in the transfer process, the toner image on the photosensitive drum is transferred onto a transfer material. After the transfer process, the cleaning process is executed to remove remaining toner on the photosensitive drum. Thereafter, the electrostatic charges on the photosensitive drum are removed by the electrostatic charge removal process, and then the electrostatic charging process is executed again.

By the way, in black-and-white printing, a recording sheet (recording medium) is used as a transfer material for the transfer process, and the toner image on the photosensitive drum is directly transferred onto the recording sheet.

On the other hand, in an image forming apparatus capable of performing color printing (hereinafter referred to as a color image forming apparatus), the transfer process is executed to transfer toner images from photosensitive drums for respective colors onto an intermediate transfer belt as a transfer material, in a superimposed manner, to thereby form a color toner image on the intermediate transfer belt. Then, the color toner image is transferred from the intermediate transfer belt onto the recording sheet.

Although in the image formation process, the photosensitive drum and the intermediate transfer belt are driven for rotation at a constant surface speed (hereinafter referred to as a processing speed), color shift and banding may be caused on an image formed on the recording sheet.

The causes of color shift and banding include fluctuations in respective processing speeds of the photosensitive drum and the intermediate transfer belt, and variation in exposure position due to shaking of an exposure device during the image forming process.

Particularly, the fluctuations in the processing speeds of the photosensitive drum and the intermediate transfer belt are a major cause of color shift and banding in image forming, development, and transfer (primary transfer and secondary transfer) in the image formation process.

Therefore, to reduce color shift and banding, it is very important to control the processing speeds of the photosensitive drum and the intermediate transfer belt to constant speeds (hereinafter referred to as constant-speed control).

However, in the color image forming apparatus, various speed fluctuation factors exist in the entire drive system. This makes it difficult to ideally control the processing speed of the photosensitive drum to a constant speed.

For example, the speed fluctuation factors include an eccentricity component of a photosensitive drum shaft, a torque fluctuation component of a motor, eccentricity and vibration components caused by a reduction unit, such as a gear, and a random load fluctuation component. Here, an example of the random load fluctuation component includes fluctuations in frictional force between the photosensitive drum and the intermediate transfer belt.

On the other hand, a motor used as a drive source of the photosensitive drum or the intermediate transfer belt is generally implemented by a brushless DC motor. The brushless DC motor is employed because of the advantages that it can be easily rotated at high speed, and it is free from step-out occurring in a stepper motor.

In executing the constant-speed control using the brushless DC motor, a so-called PLL (phase-locked loop) method or a speed discriminator method is used. In the speed discriminator method, speed feedback control using an FG (frequency generator) signal (rotation pulse signal) is carried out. In the PLL method, speed and phase feedback control using an FG signal is carried out. Further, a drive circuit converts a controlled variable output by the constant-speed control to current for driving the motor.

Here, for example, as a circuit for driving the image bearing member, a so-called bidirectional drive circuit using transistors or FETs as switching elements is used.

In the bidirectional drive circuit, the magnitude of current applied to a motor coil is controlled by a pulse width modulation method (hereinafter referred to as the PWM method), and is determined by a ratio of an on duration in which a voltage applied to a gate or a base of a switching element is on to a total of the on duration and an off duration in which the same is off (hereinafter referred to as a duty factor). That is, the bidirectional drive circuit outputs a controlled variable determined by the feedback control, in the form of duty factor, so as to carry out the constant-speed control.

However, in current control by the PWM method, there is a difference in response (time required for the speed to reach a target speed) between acceleration (acceleration response) and deceleration (deceleration response) of the motor. In acceleration, it is possible to increase the accelerating force by increasing current applied to the motor.

On the other hand, in deceleration, the limit of the decelerating force is determined by a mechanical frictional force, and hence the deceleration response is degraded in the image bearing member having a large inertia.

For example, there has been proposed an image forming apparatus which applies a braking force to a rotating shaft using a mechanical friction brake so as to improve the deceleration response (see Japanese Patent Laid-Open Publication No. 2003-195687). In this image forming apparatus, load fluctuations of a photosensitive drum are measured by a rotational load measurement unit and are stored in a rewritable memory in advance. Then, brake control is carried out according to the load fluctuations so as to improve the deceleration response.

Further, for example, there has been proposed a technique which uses a short brake to improve the braking force (see Japanese Patent Laid-Open Publication No. H11-27979). In this technique, a braking force is generated in a motor itself using negative current (electric current which generates a torque in a direction opposite to the direction of rotation of the rotating shaft) which is generated by an induced electromotive force during deceleration.

This improves the deceleration response even when the degree of attenuation of current is small. Further, according to the technique disclosed in Japanese Patent Laid-Open Publication No. H11-27979, the constant-speed control is carried out such that the PWM period is separately set in a section of the rotation driving operation and a section of the short brake operation.

As described above, when the constant-speed control of the image bearing member is performed, the deceleration response is lower than the acceleration response, and as a result, it is difficult to properly control high-frequency speed fluctuations. To cope with speed fluctuations, load fluctuations are measured in advance, and a mechanical frictional force is applied to a rotating shaft of the image bearing member, whereby feedforward control is carried out.

However, when it is attempted to improve the deceleration response by using the mechanical frictional force, not only the costs but also energy loss is increased due to a mechanism provided for applying the frictional force. Further, the feedforward control makes it difficult to cope with random disturbances produced during the image formation process.

SUMMARY OF THE INVENTION

The present invention provides an image bearing member drive unit which is capable of performing excellent follow-up of random disturbances without increasing the costs and further with reduced energy loss, a method of controlling the image bearing member drive unit, a storage medium, and an image forming apparatus.

In a first aspect of the present invention, there is provided an image bearing member drive unit that drivingly controls an image bearing member which bears a toner image, comprising a drive motor configured to drive the image bearing member, a speed detection unit configured to detect a speed of the image bearing member, a first control unit configured to control drive current for the drive motor according to the speed detected by the speed detection unit and a target speed, and a second control unit configured to generate current in a direction opposite to a direction of the drive current when a short brake signal for braking the drive motor is on.

In a second aspect of the present invention, there is provided an image forming apparatus including an image bearing member for bearing a toner image, a transfer unit configured to transfer the toner image formed on the image bearing member onto a recording sheet, and an image bearing member drive unit for drivingly controlling the image bearing member, wherein the image bearing member drive unit comprises a drive motor configured to drive the image bearing member, a speed detection unit configured to detect a speed of the image bearing member, a first control unit configured to control drive current for the drive motor according to the speed detected by the speed detection unit and a target speed, and a second control unit configured to generate current in a direction opposite to a direction of the drive current for the drive motor when a short brake signal for braking the drive motor is on.

In a third aspect of the present invention, there is provided a method of controlling an image bearing member drive unit that drivingly controls an image bearing member which bears a toner image, comprising detecting a speed of the image bearing member driven by a drive motor, controlling drive current for the drive motor according to the detected speed and a target speed, and generating current in a direction opposite to a direction of the drive current when a short brake signal for braking the drive motor is on.

In a fourth aspect of the present invention, there is provided a non-transitory computer-readable storage medium storing a computer-executable program for causing a computer to execute a method of controlling an image bearing member drive unit that drivingly controls an image bearing member which bears a toner image, wherein the method comprises detecting a speed of the image bearing member driven by a drive motor, controlling drive current for the drive motor according to the detected speed and a target speed, and generating current in a direction opposite to a direction of the drive current when a short brake signal for braking the drive motor is on.

According to the present invention, it is possible to cause the image bearing member drive unit to perform excellent follow-up of random disturbances without increasing the costs and further with reduced energy loss.

Further features of the present invention will become apparent from the following description of exemplary embodiments with reference to the attached drawings.

BRIEF DESCRIPTION OF THE DRAWINGS

FIGS. 6A to 6C are diagrams useful in explaining respective paths of current flowing though coils appearing in FIG. 3, in which FIG. 6A shows a first example of the current path formed when transistors are switched on, FIG. 6B shows a second example of the current path formed when a transistor is switched on, and FIG. 6C shows a third example of the current path formed when transistors are switched on.

DESCRIPTION OF THE EMBODIMENTS

The present invention will now be described in detail below with reference to the accompanying drawings showing embodiments thereof.

Figure 1:
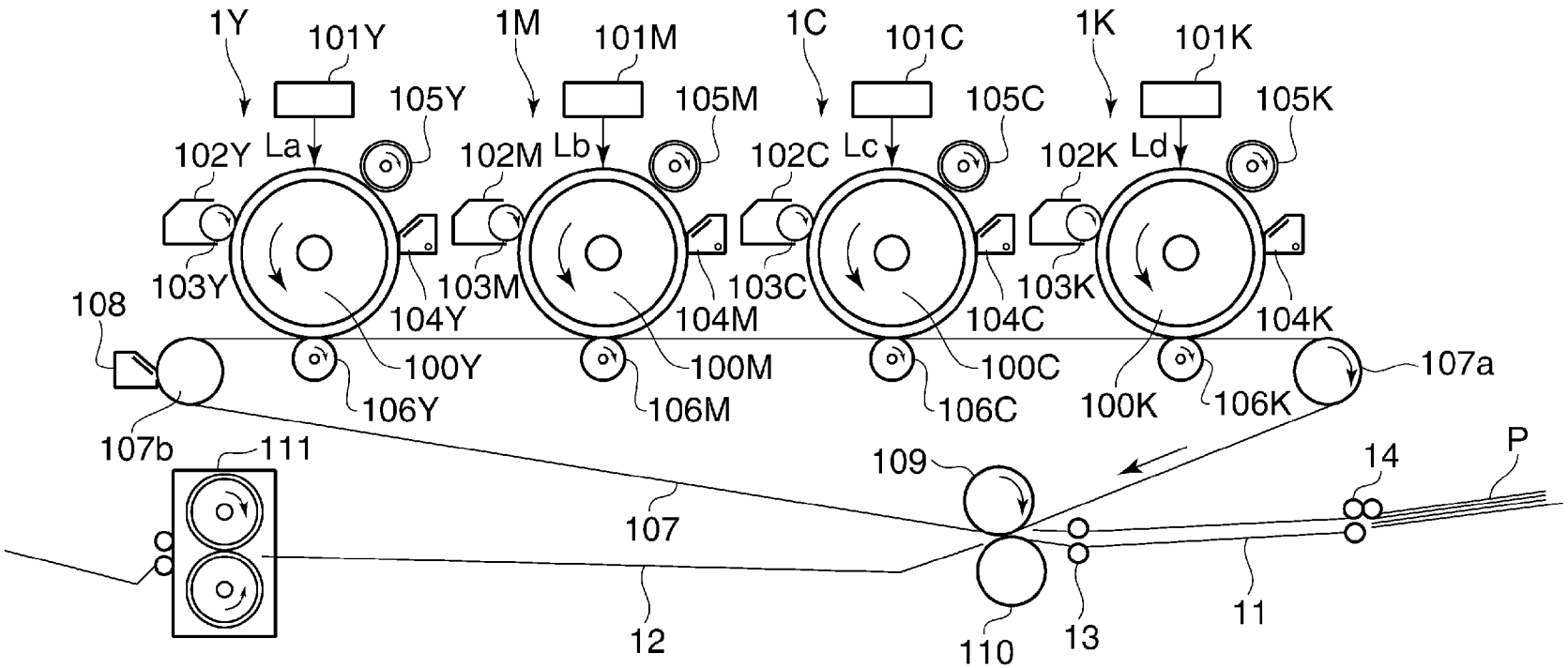
FIG. 1 is a schematic cross-sectional view of an image forming apparatus using an image bearing member drive unit according to an embodiment of the present invention.

FIG. 1 is a schematic cross-sectional view of an image forming apparatus using an image bearing member drive unit according to an embodiment of the present invention.

The illustrated image forming apparatus is a so-called tandem-type color image forming apparatus that performs image formation of four colors of yellow (Y), magenta (M), cyan (C), and black (B). More specifically, the color image forming apparatus includes image forming sections 1Y, 1M 1C, and 1K provided for the respective colors of Y, M, C, and K.

A controller (not shown) provided in the image forming apparatus controls the image forming apparatus in response to an image forming instruction. In the image forming section 1Y, a photosensitive drum 100Y as an image bearing member is driven for rotation in a direction of a solid arrow. An electrostatic charging roller 105Y is connected to a high-voltage power supply (not shown). A DC voltage or a high voltage formed by superimposing a sinusoidal voltage on a DC voltage is applied to the electrostatic charging roller 105Y. As a consequence, the photosensitive drum 100Y has its surface uniformly charged to the same potential as the DC voltage.

An exposure device 101Y irradiates the photosensitive drum 100Y with laser light La according to image data to form an electrostatic latent image on the surface of the photosensitive drum 100Y. A developing device 102Y applies a high voltage formed by superimposing a square-wave voltage on a DC voltage to a development sleeve 103Y by using a high-voltage power supply (not shown). As a consequence, the electrostatic latent image at a positive potential is developed with Y toner, whereby a Y toner image is formed on the photosensitive drum 100Y.

Similarly, in the image forming sections 1M, 1C, and 1K, the surfaces of photosensitive drums 100M, 100C, and 100K are uniformly charged by electrostatic charging rollers 105M, 105C, and 105K, respectively. Then, exposure devices 101M, 101C, and 101K irradiate the photosensitive drums 100M, 100C, and 100K with laser lights Lb, Lc, and Ld according to image data to form respective electrostatic latent images thereon.

Developing devices 102M, 102C, and 102K form an M toner image, a C toner image, and a K toner image on the photosensitive drums 100M, 100C, and 100K by development sleeves 103M, 103C, and 103K, respectively.

The respective toner images formed on the photosensitive drums 100M, 100C, and 100K are sequentially transferred by primary transfer rollers 106Y, 106M, 106C, and 106K onto an intermediate transfer belt 107 as an intermediate transfer member in a superimposed manner. As a consequence, a color image is formed on the intermediate transfer belt 107.

Note that a high DC voltage is applied to each of the primary transfer rollers 106Y, 106M, 106C, and 106K from the high-voltage power supply (not shown) to transfer each toner image.

The intermediate transfer belt 107 is stretched around a driving roller 107*a*, a driven roller 107*b*, and a tension roller 109, and is driven by the driving roller 107*a* for rotation in a direction indicated by a solid arrow. A secondary transfer roller 110 is disposed at a location opposed to the tension roller 109 across the intermediate transfer belt 107.

A recording sheet (hereinafter simply referred to as the sheet) P is conveyed along a conveying path 11 by a conveying roller 14. When a leading edge of the sheet P is detected by a registration sensor (not shown), the sheet P is temporarily held by a registration roller 13.

The sheet P is conveyed by the registration roller 13 in synchronism with driven rotation of the intermediate transfer belt 107 to a secondary transfer position defined by a nip between the tension roller 109 and the secondary transfer roller 110.

In the secondary transfer position, the color toner image on the intermediate transfer belt 107 is transferred onto the sheet P. Note that a high DC voltage is applied to the secondary transfer roller 110 from the high-voltage power supply (not shown) to transfer the color toner image.

The sheet P on which the color toner image has been transferred is conveyed to a fixing device 111 along a conveying path 12. Then, the color toner image is fixed on the sheet P by the fixing device 111, and the sheet P on which the toner image has been fixed is discharged e.g. to a discharge tray (not shown).

Toner remaining on the surfaces of the photosensitive drums 100Y, 100M, 100C, and 100K is scraped and collected by cleaners 104Y, 104M, 104C, and 104K, respectively. Toner remaining on the intermediate transfer belt 107 is collected by a belt cleaner 108.

Figure 2:
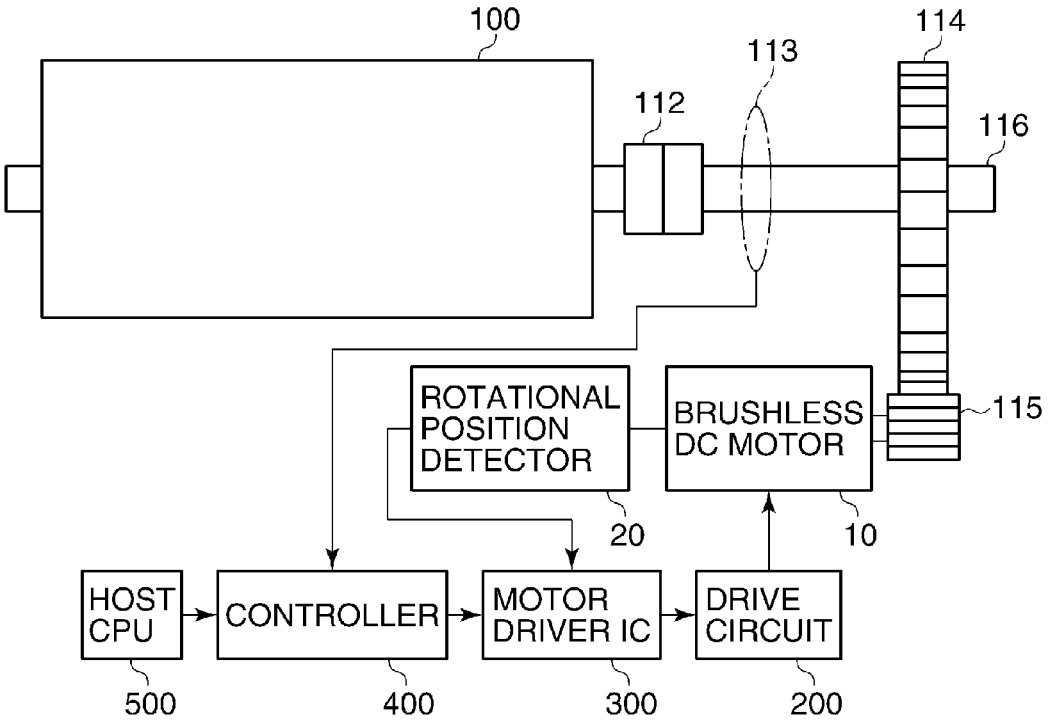
FIG. 2 is a schematic view of a drive unit which drivingly controls a photosensitive drum appearing in FIG. 1.

FIG. 2 is a schematic view of a drive unit which drivingly controls the photosensitive drum appearing in FIG. 1. Note that the drive units which drive the photosensitive drums 100Y to 100K each have the same configuration, and hence the photosensitive drum is denoted by reference numeral 100 in FIG. 2.

A drum shaft 116 is connected to a rotating shaft of the photosensitive drum 100 by a coupling 112. A reduction gear 114 is fitted on the drum shaft 116, and is meshed with a motor shaft gear 115. Further, the motor shaft gear 115 is connected to a brushless DC motor (drive motor) 10 which is a drive source.

As shown in FIG. 2, a rotary encoder (hereinafter simply referred to as an encoder) 113 is disposed on a drum shaft 116, and a rotational speed (also referred to as the drive speed) of the drum shaft 116, i.e. a photosensitive drum 100, is detected by the encoder (speed detection unit) 113. Further, the encoder 113 sends a rotational speed detection signal to a controller 400.

A rotational position detector 20 is connected to a brushless DC motor 10, and the rotational position of a rotor of the brushless DC motor 10 is detected by the rotational position detector 20. Further, the rotational position detector 20 sends a rotational position detection signal to a motor driver IC 300.

Note that although the rotational position detector 20 is implemented e.g. by a hall element, the rotational position detector 20 is not limited to the hall element but any suitable sensor may be used insofar as it is a magnetic flux sensor.

A host CPU 500 controls the driving timing and processing speed of a load member (e.g. the photosensitive drum) during the image formation process. The host CPU 500 determines the processing speed according to the type of sheet. Then, the host CPU 500 provides a driving timing signal and a processing speed signal to the controller 400.

The controller 400 executes speed feedback control according to the driving timing signal, the processing speed signal, and the rotational speed detection signal, and provides a drive control signal to the motor driver IC 300.

As the controller 400, a CPU which is high in computation speed, such as a DSP (digital signal processor), is used. Further, an FPGA (field programmable gate array) or an ASIC (application specific integrated circuit) may be used as the controller 400, and may be selected according to e.g. the computation speed and the costs.

The motor driver IC (integrated circuit) 300 controls a drive circuit 200 based on the drive control signal and the rotational position detection signal. The drive circuit 200 adjusts drive current to be provided to the brushless DC motor 10 under the control of the motor driver IC 300.

For example, the drive control signals include a pulse width modulation (PWM) signal (PWM_SIG), a short brake signal (BRK_SIG), and an enable signal (ENABLE_SIG). The motor driver IC 300 controls the drive circuit 200 according to PWM_SIG and BRK_SIG to thereby adjust the drive current to be provided to the brushless DC motor 10.

Figure 3:
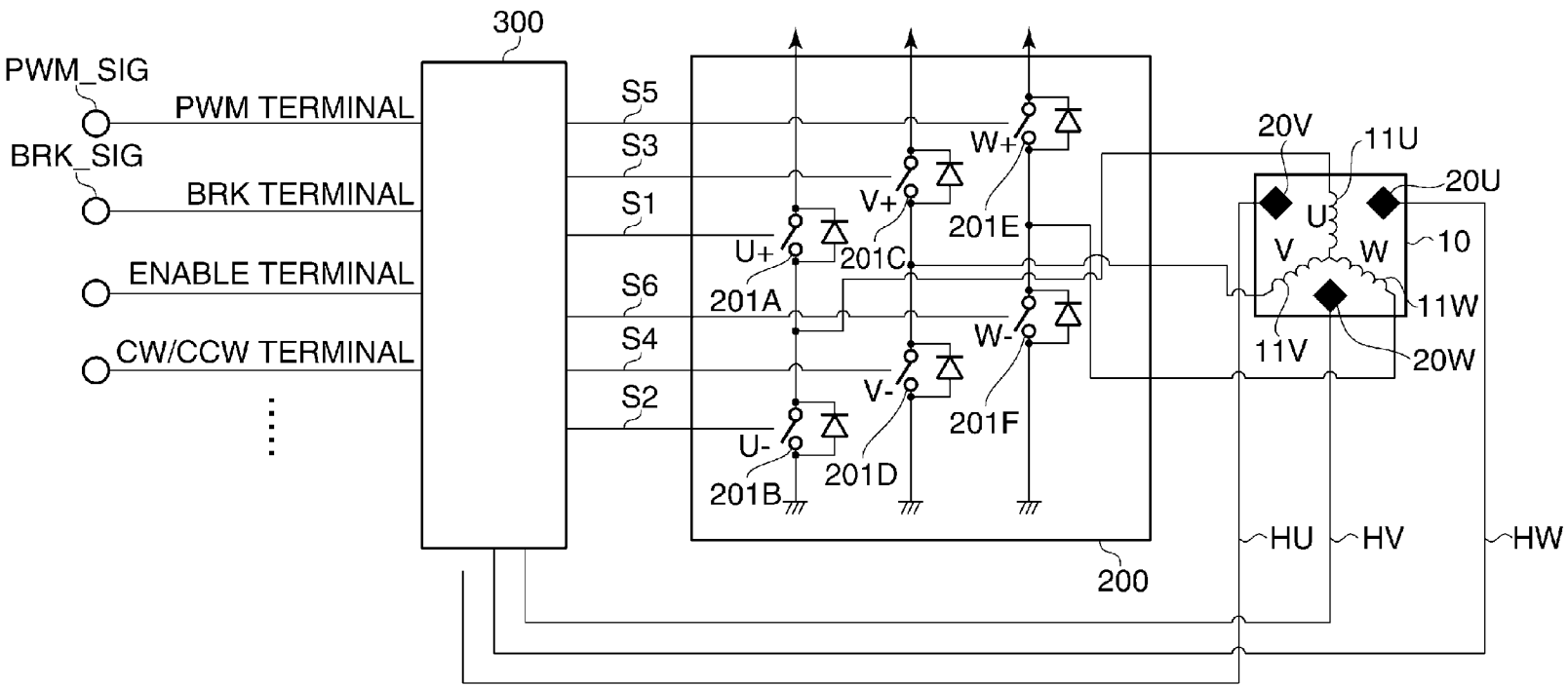
FIG. 3 is a circuit diagram useful in explaining the operation of a brushless DC motor appearing in FIG. 2.

FIG. 3 is a circuit diagram useful in explaining the operation of the brushless DC motor 10 appearing in FIG. 2.

As shown in FIG. 3, the motor driver IC 300 includes a PWM terminal, a BRK terminal, an ENABLE terminal, and a CW/CCW terminal (rotational direction control terminal). The motor driver IC 300 outputs switching signals S1 to S6, as described hereinafter.

The drive circuit 200 is a bidirectional drive circuit including transistors 201A, 201B, 201C, 201D, 201E, and 201F as switching elements. Diodes are connected to the transistors 201A, 201B, 201C, 201D, 201E, and 201F in parallel, respectively. These transistors 201A, 201B, 201C, 201D, 201E, and 201F are on/off-controlled according to the switching signals S1 to S6, respectively.

The transistors 201A and 201B are connected in series, and the transistors 201C and 201D are connected in series. Further, the transistors 201E and 201F are connected in series.

In the present embodiment, as the brushless DC motor 10, a multiphase brushless DC motor, e.g. a three-phase brushless DC motor is used, and the brushless DC motor 10 is controlled by the motor driver IC 300.

The brushless DC motor 10 includes coils 11U, 11V, and 11W, and hall elements 20U, 20V, and 20W are disposed in the brushless DC motor 10 at intervals of 120 degrees. The rotational position detector 20 is formed by these hall elements 20U, 20V, and 20W, and detects the rotational position of the rotor of the brushless DC motor 10.

As shown in FIG. 3, a connection point of the transistors 201A and 201B is connected to the coil 11U, and a connection point of the transistors 201C and 201D is connected to the coil 11V. Further, a connection point of the transistors 201E and 201F is connected to the coil 11W.

The motor driver IC 300 receives the rotational position detection signals HU, HV, and HW from the hall elements 20U, 20V, and 20W, respectively, and controls the drive circuit 200 by the switching signals S1 to S6 to determine timings for passing drive current to the coils 11U, 11V, and 11W.

As described above, since the hall elements 20U, 20V, and 20W are disposed in the brushless DC motor 10 at intervals of 120 degrees, it is possible to detect a periodically changing position of the rotor, by the hall elements 20U, 20V, and 20W.

The motor driver IC 300 obtains six kinds of detection signal patterns from the hall elements 20U, 20V, and 20W according to rotation of the rotor. Then, the motor driver IC 300 switches the switching signals according to the detection signal pattern to thereby perform switching of energization of the coils 11V, 11U, and 11W.

In the illustrated example, the number of magnetic poles of the rotor (not shown) of the brushless DC motor 10 is set to multiples of 2 (2N: N is an integer not less than 1), and a mechanical rotational angle of the brushless DC motor 10 caused by energization switching is an angle obtained by dividing 360° by N.

Figure 4:
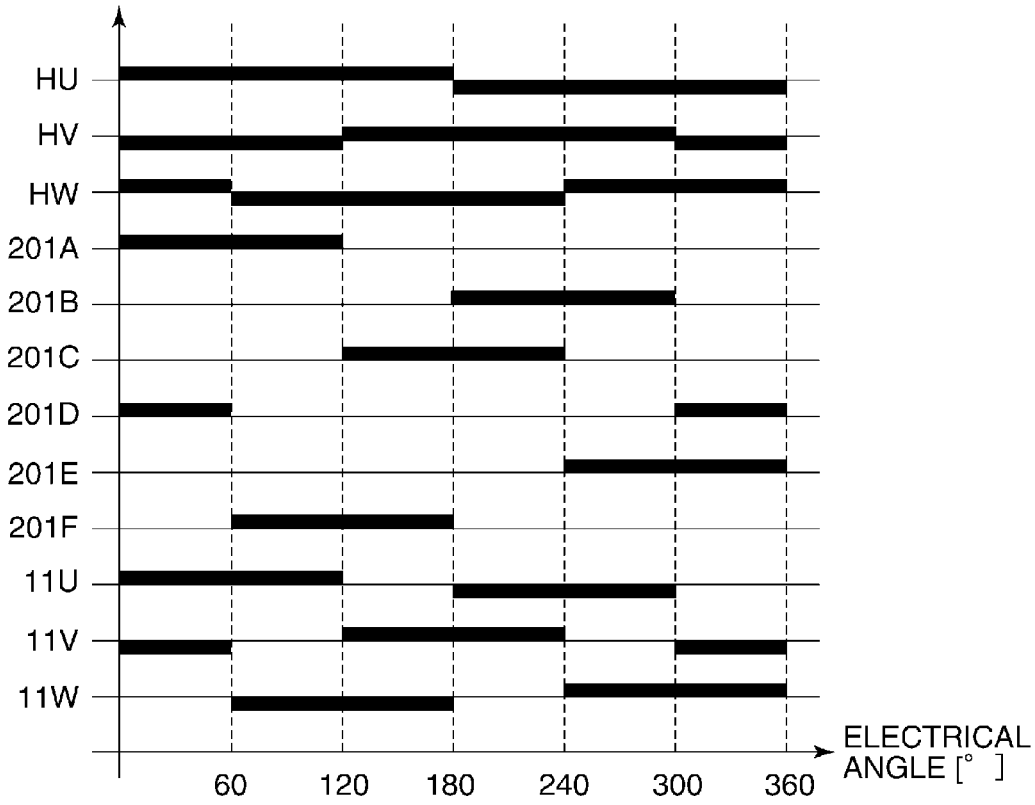
FIG. 4 is a diagram useful in explaining changes in current caused by energization switching in the circuit shown in FIG. 3.

FIG. 4 is a diagram useful in explaining changes in current caused by energization switching in the circuit shown in FIG. 3.

In FIG. 4, the horizontal axis represents an electrical angle. The rotational position detection signal HU is at a high (H) level when the electrical angle is from 0 to 180 degrees, and is at a low (L) level when the electrical angle is from 180 to 360 degrees. Further, the rotational position detection signal HV is at a high level when the electrical angle is from 120 to 300 degrees, and is at a low level when the electrical angle is from 300 to 120 degrees. Further, the rotational position detection signal HW is at a high level when the electrical angle is from 240 to 60 degrees, and is at a low level when the electrical angle is from 60 to 240 degrees.

Therefore, as mentioned above, six patterns of the detection signals are provided to the motor driver IC 300, and the motor driver IC 300 determines the electrical angle of the brushless DC motor 10, i.e. the rotational position of the rotor according to the detection signal pattern.

According to the detection signal pattern, i.e. the rotational position of the rotor, the motor driver IC 300 holds the transistor 201A on in an electrical angle range of 0 to 120 degrees. Further, the motor driver IC 300 holds the transistor 201B on in an electrical angle range of 180 to 300 degrees, and holds the transistor 201C on in an electrical angle range of 120 to 240 degrees.

Further, the motor driver IC 300 holds the transistor 201D on in an electrical angle range of 300 to 60 degrees, and holds the transistor 201E on in an electrical angle range of 240 to 360 degrees. Further, the motor driver IC 300 holds the transistor 201F on in an electrical angle range of 60 to 180 degrees.

As a result, current flows through the coil 11U in a first direction in the electrical angle range of 0 to 120 degrees, and in a second direction opposite to the first direction in the electrical angle range of 180 to 300 degrees.

Similarly, current flows through the coil 11V in the first direction in the electrical angle range of 120 to 240 degrees, and in the second direction in the electrical angle range of 300 to 60 degrees. Further, current flows through the coil 11W in the first direction in the electrical angle range of 240 to 360 degrees, and in the second direction in the electrical angle range of 60 to 180 degrees.

The controller 400 appearing in FIG. 2 executes the speed feedback control and the short brake control. Here, the constant-speed control executed by only the speed feedback control will be described, and then the constant-speed control executed by a combination of the speed feedback control and the short brake control will be described.

In the speed feedback control, a controlled variable is determined according to the difference between the rotational speed (ENC_V) indicated by the rotational speed signal output from the rotary encoder 113 and the processing speed (PV). In the illustrated example, since the constant-speed control is executed by the current control by the PWM method, the controlled variable corresponds to the duty factor (PWM_Duty).

Figure 5:
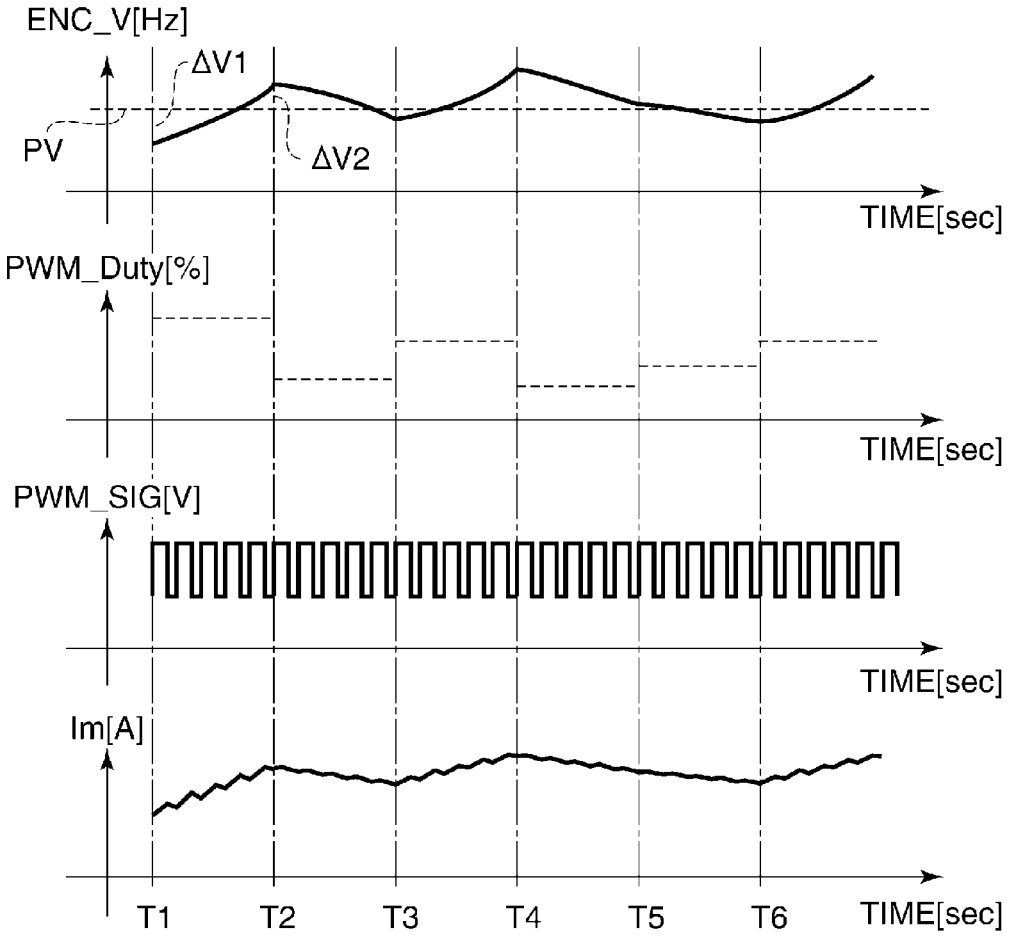
FIG. 5 is a diagram useful in explaining changes with time in control signals and coil current in speed feedback control.

FIG. 5 is a diagram useful in explaining changes with time in each control signal and coil current in the speed feedback control.

In FIG. 5, a switching signal which controls on/off of the transistors 201A to 201F is indicated by PWM_SIG, and current flowing through the coils 11U, 11V, and 11W is indicated by Im. Further, times T1 to T6 each indicate sampling timing by the controller 400. Further, ΔV1 and ΔV2 in FIG. 5 indicate a difference between PV (the processing speed) and ENC_V (the rotational speed) at the times T1 and T2, respectively.

Now, assuming that ΔV1=ΔV2, at the time T1, ENC_V is lower than PV by ΔV1. Therefore, the controller 400 increases PWM_Duty, whereby the coil current Im gradually increases.

On the other hand, at the time T2, ENC_V is higher than PV by ΔV2, and hence the controller 400 reduces PWM_Duty to gradually reduce the coil current Im. Then, the controller 400 similarly controls the coil current Im also at the other times T3 to T6.

Figure 6A:
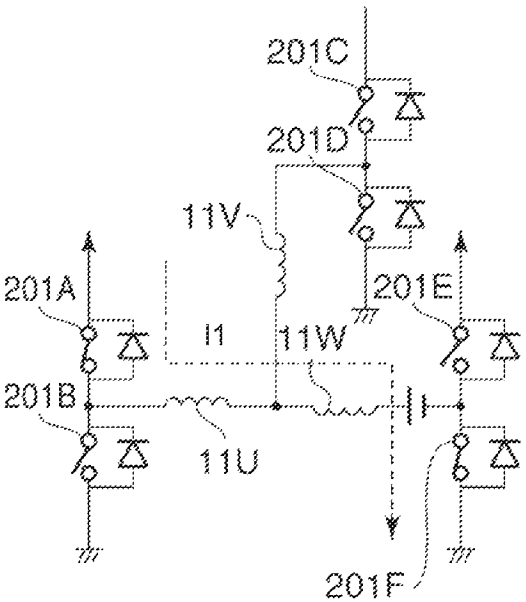
Figure 6B:
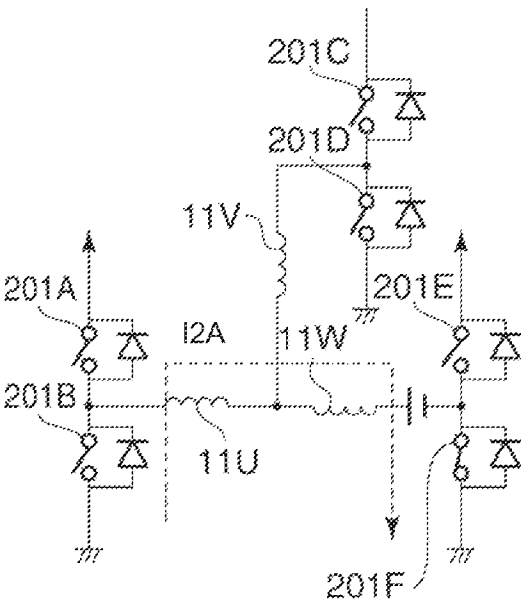
Figure 6C:
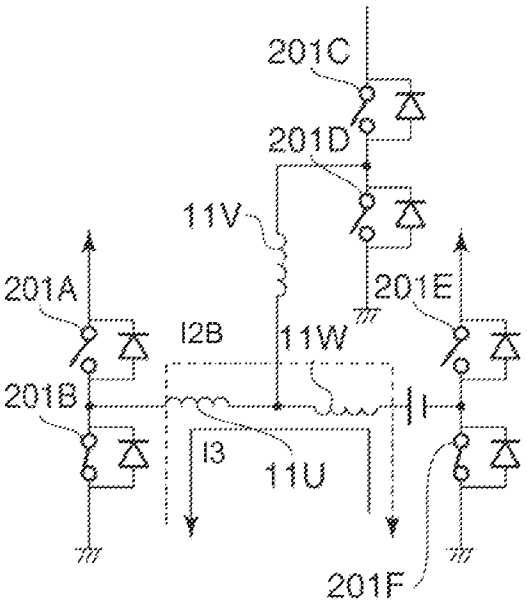

FIGS. 6A to 6C are diagrams useful in explaining respective paths of current flowing though the coils 11U, 11V, and 11W appearing in FIG. 3, in which FIG. 6A shows a current path formed when the transistors 201A and 201F are on, FIG. 6B shows a current path formed when the transistor 201F is on, and FIG. 6C shows a current path formed when the transistors 201B and 201F are on.

As shown in FIG. 6A, when the transistors 201A and 201F are switched on, the coil current Im=I1 flows from the power supply side via the transistor 201A through the coils 11U and 11W while being increased, and then via the transistor 201F to ground GND.

As shown in FIG. 6B, when the transistor 201A is switched off, the coil current Im=I2A flows from the diode arranged in parallel with the transistor 201B through the coils 11U and 11W by a self-induced electromotive force and a back electromotive force of the coils 11U and 11V while being attenuated, and then via the transistor 201F to ground GND.

As can be easily understood from examples shown in FIGS. 6A and 6B, although it is possible to increase the acceleration of the brushless DC motor 10 by adjusting the coil current Im, the maximum value of the deceleration force is determined by the frictional force. As a result, the magnitude of the deceleration becomes smaller than that of the acceleration.

On the other hand, when the short brake control is used in combination with the speed feedback control, as shown in FIG. 6C, the transistors 201B and 201F are switched on, whereby current I2B flows through the coils 11U and 11W via the transistor 201B and the diode arranged in parallel with the transistor 201B.

Further, current I3 in the opposite direction flows through the coils 11U and 11W via the transistor 201F and the diode arranged in parallel with the transistor 201F. As a result, the magnitude of the coil current Im becomes equal to the absolute value of (I2B−I3). Here, the above-mentioned current I3 is generated by the short brake control.

Now, when the short brake signal (BRK_SIG) is provided from the controller 400 to the motor driver IC 300 in the state shown in FIG. 6A, the motor driver IC 300 forcibly stops the PWM signal PWM_SIG applied to the transistor 201A. Then, the motor driver IC 300 switches off the transistor 201A, and thereafter switches on the transistor 201B.

As a result, as shown in FIG. 6C, the currents I2B and I3 in the respective opposite directions flow through the coils 11U and 11W. Here, the transistor 201B has been switched on, whereby the current I2B flows through the diode arranged in parallel with the transistor 201B and also flows between an emitter and a collector of the transistor 201B. Then, when energy of the self-induced electromotive force runs out, the current I2B ceases to flow. On the other hand, the current I3 is generated by a back electromotive force generated by a magnetic flux interlinking the coils 11U and 11W.

Figure 7:
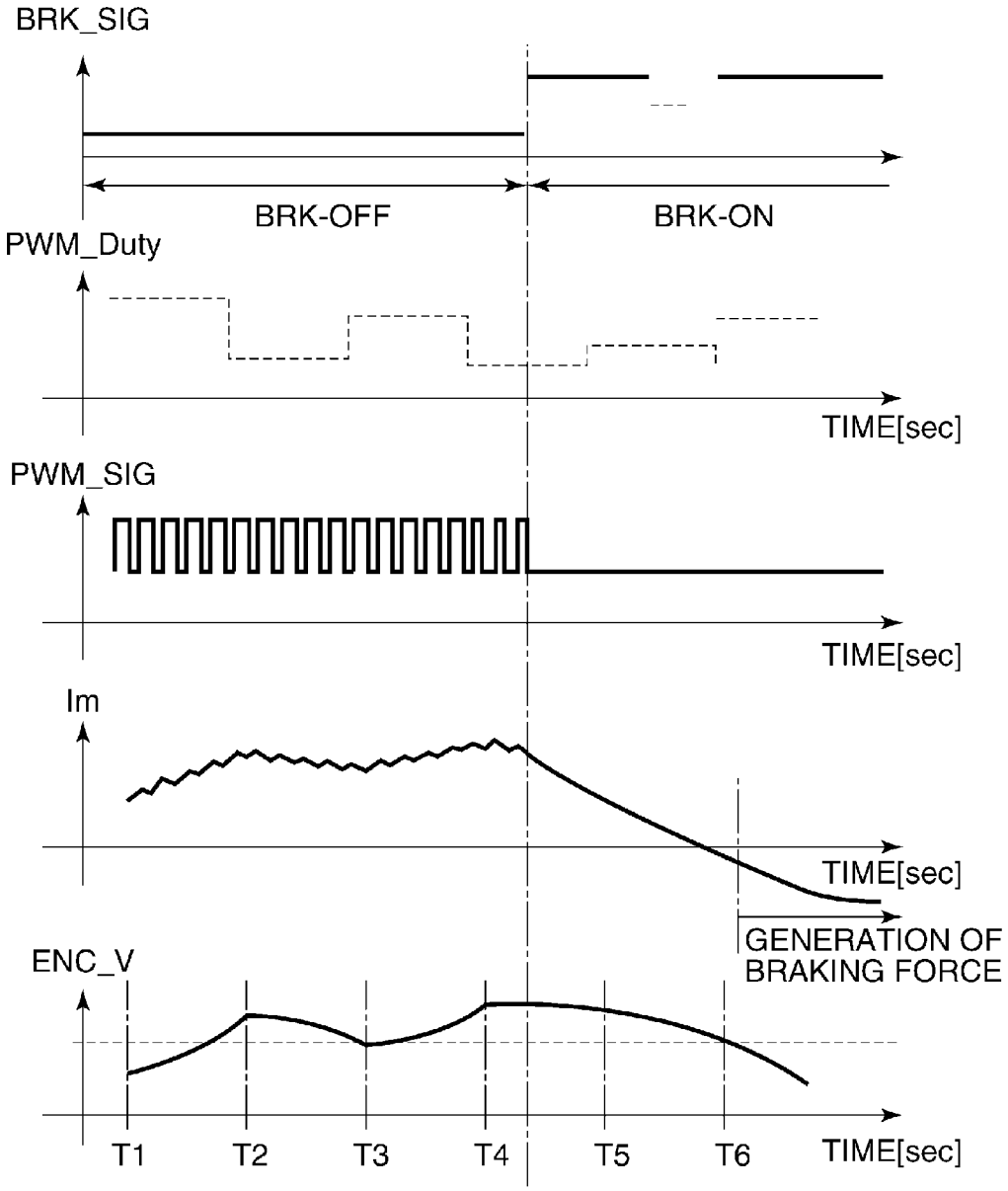
FIG. 7 is a timing diagram useful in explaining changes with time in the control signals and the coil current in a case where short brake control is used in combination with the speed feedback control.

FIG. 7 is a timing diagram useful in explaining changes with time in the control signals and the coil current in a case where the short brake control is used in combination with the speed feedback control. Here, during a BRK-OFF period in which the short brake signal (BRK_SIG) is off, the above-described constant-speed control by the speed feedback control is executed.

Now, when it enters a BRK_ON period in which BRK_SIG is on, the controller 400 switches off PWM_SIG to attenuate the current such that a short brake is applied.

As a consequence, as described above, the back electromotive force causes the current I3 to flow, which results in the flow of negative current (current flowing to generate torque in the rotational direction is defined as positive current) through the coil. As a result, a braking force is generated in the brushless DC motor 10, whereby the deceleration of the photosensitive drum 100 is increased.

As described above, by executing the constant-speed control by a combination of the speed feedback control and the short brake control, it is possible to improve the deceleration response compared with the constant-speed control executed only by the speed feedback control.

Figure 8:
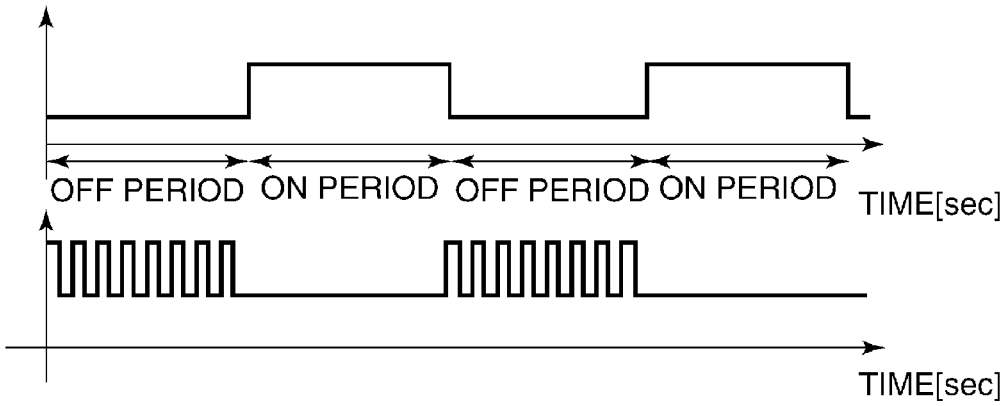
FIG. 8 is a timing diagram useful in explaining timing of executing the short brake control in a case where the short brake control is used in combination with the speed feedback control.

FIG. 8 is a timing diagram useful in explaining timing of executing the short brake control in a case where the short brake control is used in combination with the speed feedback control.

Depending on the processing speed, the short brake control is executed at a predetermined period, or also with a predetermined duty factor. In the present embodiment, the short brake control is defined by the period and duty factor of BRK_SIG provided from the controller 400 to the motor driver IC 300. That is, when BRK_SIG is on, the short brake control is executed, whereas when BRK_SIG is off, the speed feedback control is executed.

Note that the period and duty factor of BRK_SIG are set according to the processing speed as described above. Further, the period and duty factor of BRK_SIG may be set according to load.

In this case, it is assumed that the frequency of PWM_SIG (PWM frequency) is sufficiently larger than the frequency of BRK_SIG (BRK frequency). For example, the PWM frequency is set to 24 kHz, and the BRK frequency is set to 500 Hz.

Figure 9:
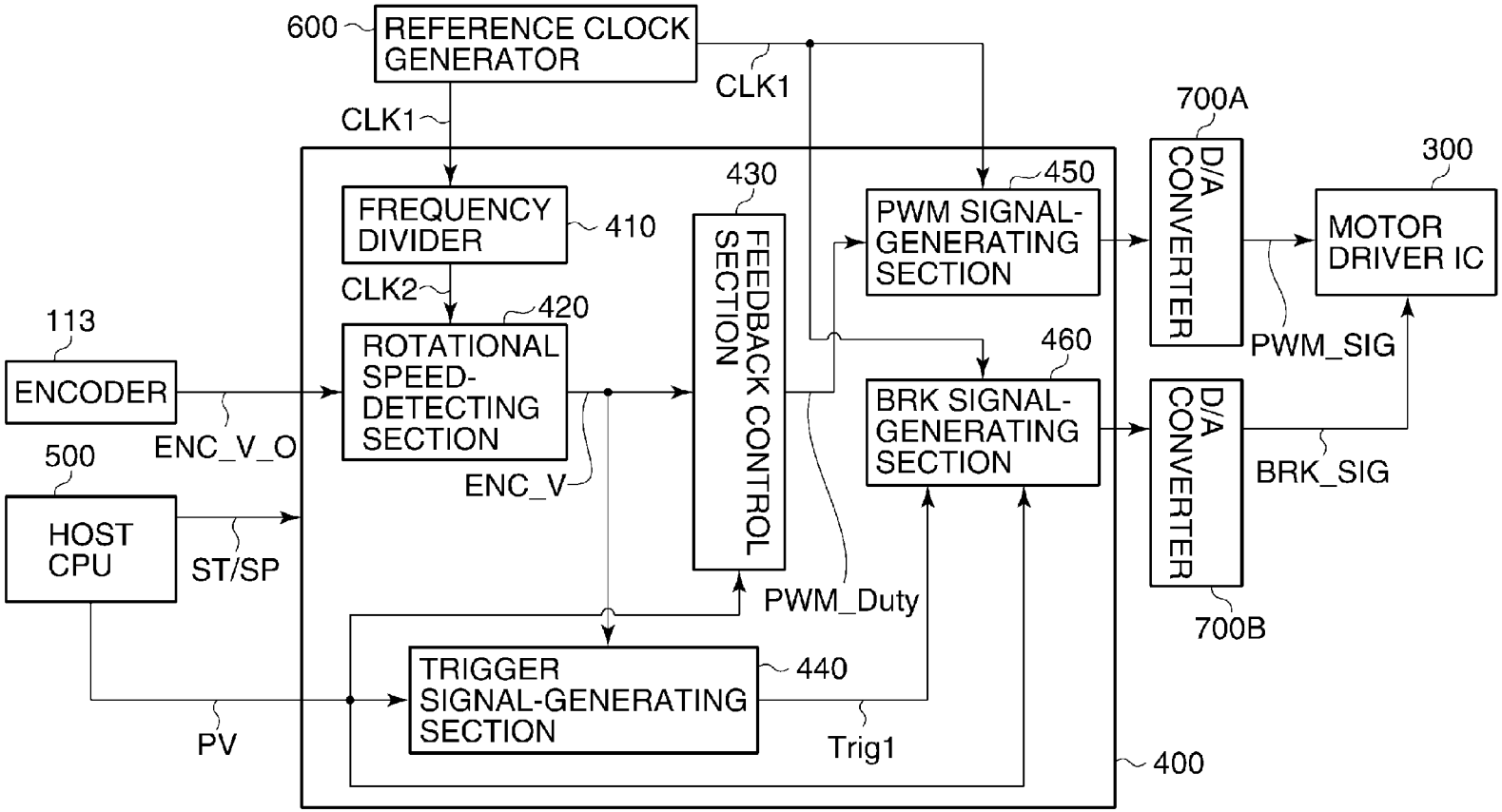
FIG. 9 is a block diagram of the hardware configuration of a controller appearing in FIG. 2.

FIG. 9 is a block diagram of the hardware configuration of the controller 400 appearing in FIG. 2.

The controller 400 comprises a frequency divider 410, a rotational speed-detecting section 420, a feedback control section 430, a trigger signal-generating section 440, a PWM signal-generating section 450, and a BRK signal-generating section 460.

The frequency divider 410 divides the frequency of a reference clock signal CLK1 provided from a reference clock generator 600, and provides a frequency-divided clock signal CLK2 to the rotational speed-detecting section 420. The frequency divider 410 operates using an ST/SP signal (start/stop signal) provided from the host CPU 500 as a trigger signal.

The rotational speed-detecting section 420 measures an edge period of a rotational speed detection signal (pulse signal) ENC_V_0 delivered from the encoder 113 according to the frequency-divided clock signal CLK2 to thereby determine the rotational speed. Then, the rotational speed-detecting section 420 outputs the rotational speed signal (ENC_V signal).

The ST/SP signal from the host CPU 500 and the processing speed signal (PV signal) indicative of the processing speed (PV) are input to the feedback control section 430. Further, the ENC_V signal is input to the feedback control section 430. Then, the feedback control section 430 operates according to the ST/SP signal to generate the controlled variable PWM_Duty based on the PV signal and the ENC_V signal, and outputs the generated controlled variable PWM_Duty to the PWM signal-generating section 450.

The PV signal and the ENC_V signal are provided to the trigger signal-generating section 440. Then, if a range of fluctuations of the rotational speed (ENC_V) indicated by the ENC_V signal with respect to the processing speed (PV) indicated by the PV signal is within a predetermined fluctuation range (e.g. ±5%), the trigger signal-generating section 440 outputs a trigger signal Trig1 to the BRK signal-generating section 460.

The PWM signal-generating section 450 outputs the PWM signal according to the reference clock signal CLK1 provided from the reference clock generator 600 and the controlled variable PWM_Duty. The PWM signal is subjected to digital-to-analog conversion by a digital-to-analog converter 700A, and is provided to the motor driver IC 300, as PWM_SIG.

The BRK signal-generating section 460 generates the short brake signal according to the trigger signal Trig1, the PV signal, and the reference clock signal CLK1. The short brake signal is converted from a digital signal to an analog signal by a digital-to-analog converter 700B, and is provided to the motor driver IC 300, as BRK_SIG.

Figure 10:
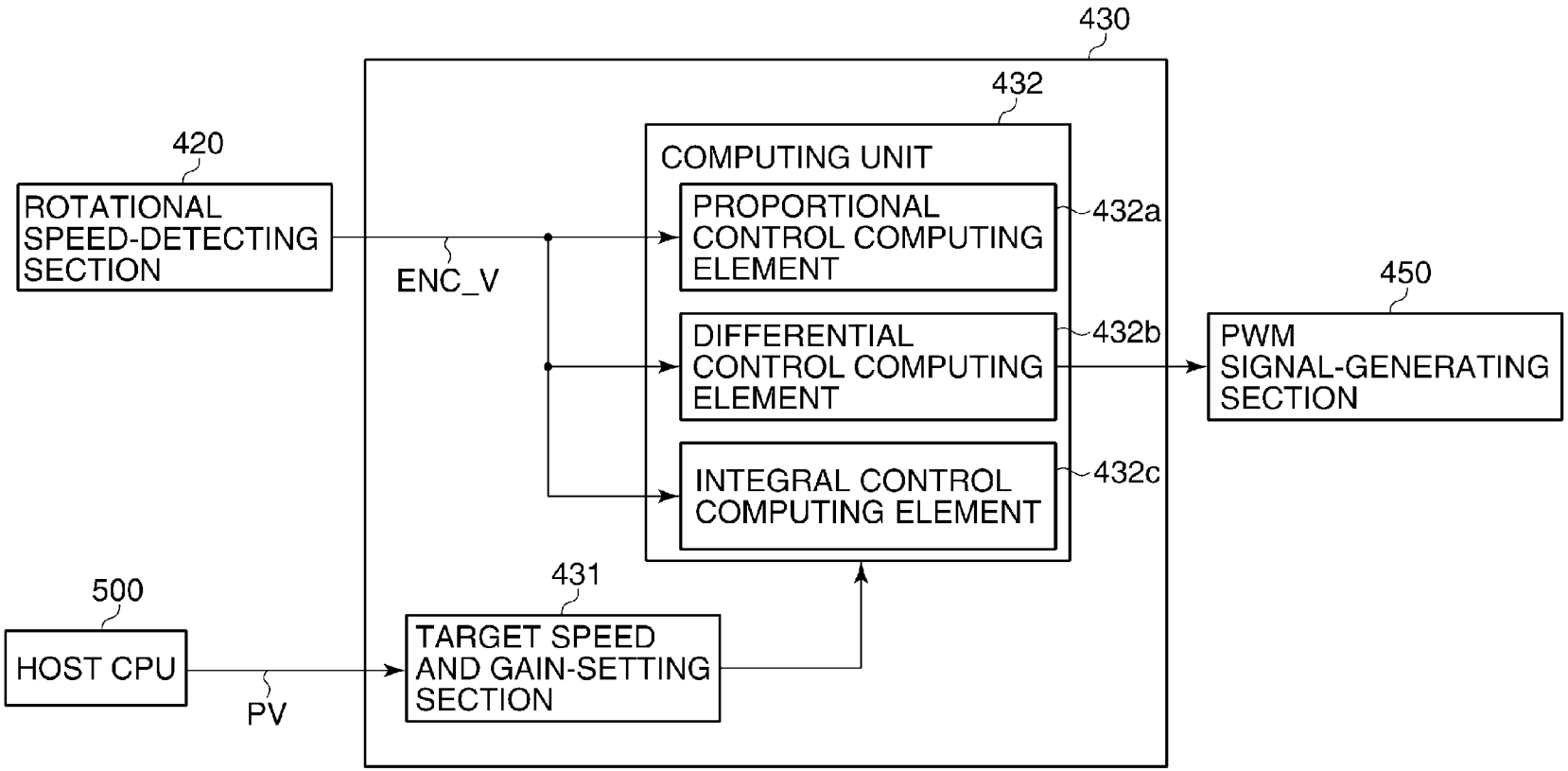
FIG. 10 is a block diagram of a feedback control section and circuit elements connected thereto, appearing in FIG. 9.

FIG. 10 is a block diagram of the feedback control section 430 and circuit elements connected thereto, appearing in FIG. 9.

In FIG. 10, the feedback control section 430 includes a target speed and gain-setting section 431, to which the PV signal is provided from the host CPU 500. Then, the target speed and gain-setting section 431 outputs a target speed according to the PV signal, and outputs gain setting values for proportional control, differential control, and integral control to a computing unit 432.

The computing unit 432 includes a proportional control computing element 432*a*, a differential control computing element 432*b*, and an integral control computing element 432*c*. The proportional control computing element 432*a* executes proportional control based on the ENC_V signal output from the rotational speed-detecting section 420, the target speed, and the gain setting value for proportional control.

Further, the differential control computing element 432*b* executes differential control based on the ENC_V signal, the target speed, and the gain setting value for differential control. Further, the integral control computing element 432*c* executes integral control based on the ENC_V signal, the target speed, and the gain setting value for integral control.

The computing unit 432 outputs a computation result obtained by the proportional control, the differential control, and the integral control to the PWM signal-generating section 450 as PWM_Duty.

Figure 11:
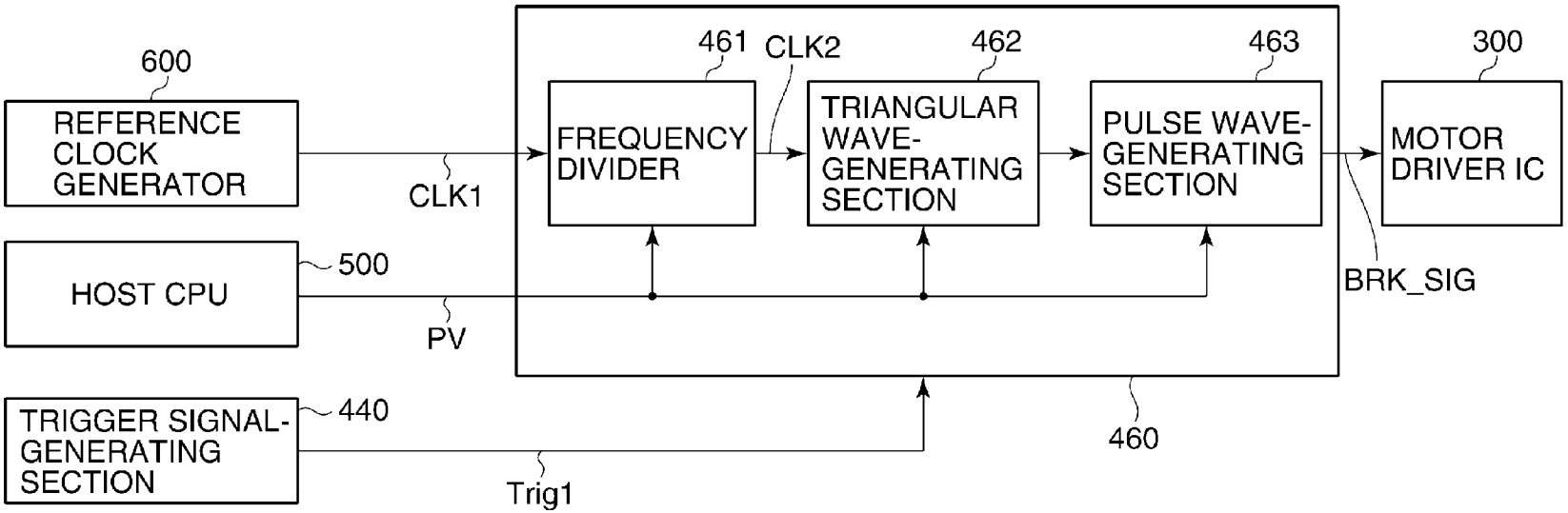
FIG. 11 is a block diagram of a BRK signal-generating section and circuit elements connected thereto, appearing in FIG. 9.

FIG. 11 is a block diagram of the BRK signal-generating section 460 and circuit elements connected thereto, appearing in FIG. 9.

The BRK signal-generating section 460 includes a frequency divider 461, a triangular wave-generating section 462, and a pulse wave-generating section 463. The frequency divider 461 determines a count frequency by dividing the frequency of the reference clock signal CLK1 provided from the reference clock generator 600 by the PV signal. Then, the frequency divider 461 outputs the frequency-divided clock signal CLK2 dependent on the count frequency to the triangular wave-generating section 462.

The triangular wave-generating section 462 generates a triangular wave signal by counting the frequency-divided clock signal CLK2 for a predetermined time period, using the processing speed indicated by the PV signal as a threshold value, and then resetting the count. Then, the triangular wave-generating section 462 outputs the generated triangular wave to the pulse wave-generating section 463.

The pulse wave-generating section 463 generates BRK_SIG at the frequency and duty factor dependent on the processing speed, according to the PV signal and the triangular wave, and outputs the generated BRK_SIG to the motor driver IC 300.

Figure 12:
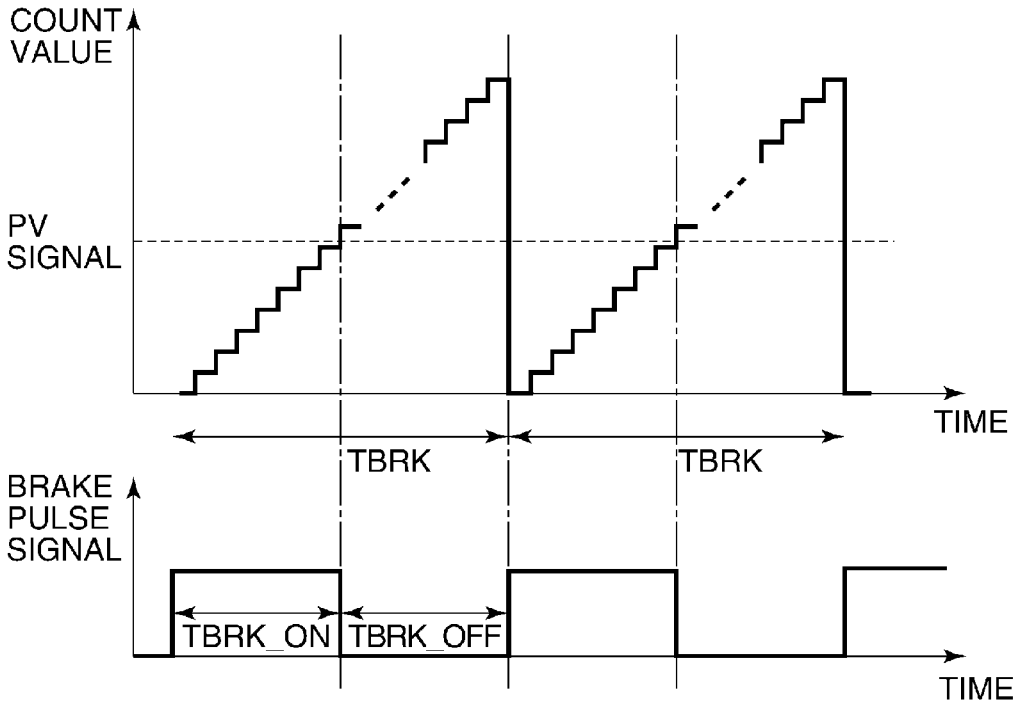
FIG. 12 is a timing diagram useful in explaining generation of a BRK signal, performed by the BRK signal-generating section appearing in FIG. 11.

FIG. 12 is a timing diagram useful in explaining generation of the short brake signal (BRK_SIG), performed by the BRK signal-generating section 460 appearing in FIG. 11.

As mentioned above, the PV signal and the frequency-divided clock signal CLK2 are provided to the triangular wave-generating section 462. The triangular wave-generating section 462 counts the frequency-divided clock signal CLK2 for a predetermined time period TBRK, and resets the counting after the time period TBRK has elapsed to thereby generate the triangular wave.

The pulse wave-generating section 463 generates BRK_SIG having a predetermined duty factor dependent on the processing speed, using threshold value indicated by the PV signal.

Figure 13:
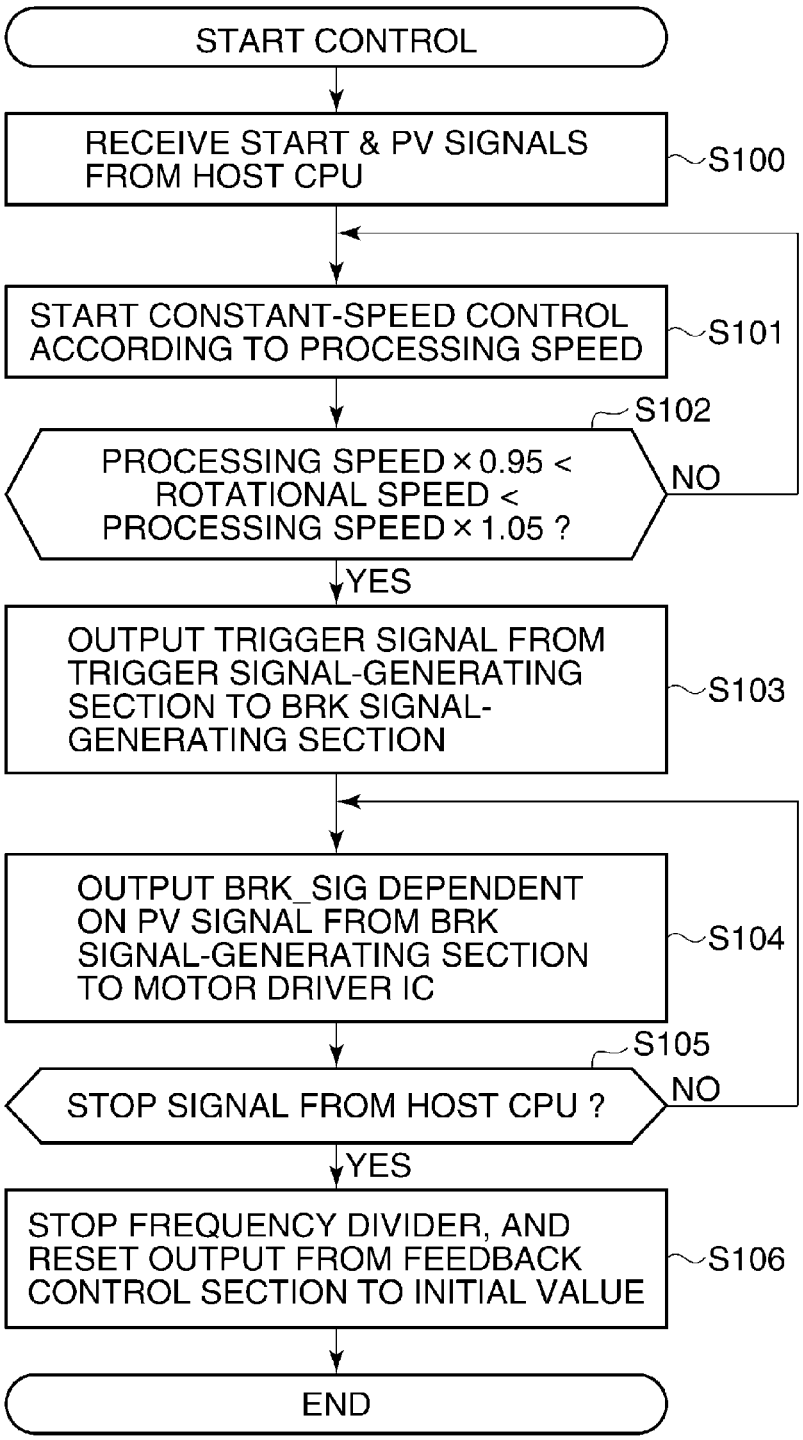
FIG. 13 is a flowchart of a control process executed by the controller shown in FIG. 9.

FIG. 13 is a flowchart of a control process executed by the controller 400 shown in FIG. 9.

Referring to FIGS. 9 and 13, when the START signal and the PV signal are input from the host CPU 500 (step S100), the controller 400 starts the control. Then, the feedback control section 430 executes the constant-speed control by the speed feedback control according to the PV signal (step S101).

The trigger signal-generating section 440 determines whether or not the rotational speed indicated by the ENC_V signal is within a predetermined range (e.g. ±5%) with respect to a target processing speed (step S102). If the rotational speed is not within the predetermined range (NO to the step S102), the constant-speed control by the feedback control section 430 is continued.

On the other hand, if the rotational speed is within the predetermined range (YES to the step S102), the trigger signal-generating section 440 outputs the trigger signal Trig1 to the BRK signal-generating section 460, as described above (step S103). Then, the BRK signal-generating section 460 outputs the short brake signal (BRK_SIG) according to the PV signal to the motor driver IC 300 in response to the trigger signal Trig1 (step S104).

Next, the controller 400 determines whether or not the STOP signal has been delivered from the host CPU 500 (step S105). If the STOP signal is not input (NO to the step S105), the controller 400 continues to deliver the short brake signal.

If the STOP signal has been input (YES to the step S105), the controller 400 stops the frequency divider 410, and resets the output from the feedback control section 430 to the initial value (step S106). Then, the controller 400 terminates the control.

As described above, in the embodiment of the present invention, in controlling the rotation of the image bearing member, such as the photosensitive drum, to constant speed, using the brushless DC motor, the braking force is periodically generated in the brushless DC motor, and hence it is possible to improve the deceleration response of the brushless DC motor.

This makes it possible for the image forming apparatus to reduce the speed fluctuation frequency which causes color shift and banding. Further, it is possible to cause the image bearing member to perform excellent follow-up of random disturbances without increasing the costs and further while reducing energy loss.

As is clear from the above description, the controller 400, the motor driver IC 300, and the drive circuit 200 appearing in FIG. 2 function as a first control unit and a second control unit. The controller 400 further functions as a determination unit and as a generation unit.

Note that the image bearing member drive unit is formed by the brushless DC motor 10, the rotational position detector 20, the rotary encoder 113, the drive circuit 200, the motor driver IC 300, and the controller 400, appearing in FIG. 2.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

For example, by configuring a control method such that steps thereof correspond to the functions of the present embodiment, the control method may be executed by an image bearing member drive unit. Further, a program having the functions of the above-described embodiment may be configured as a control program, and the control program may be executed by a computer included in the image bearing member drive unit. The control program is recorded e.g. in a computer-readable storage medium.

Aspects of the present invention can also be realized by a computer of a system or apparatus (or devices such as a CPU or MPU) that reads out and executes a program recorded on a memory device to perform the functions of the above-described embodiment, and by a method, the steps of which are performed by a computer of a system or apparatus by, for example, reading out and executing a program recorded on a memory device to perform the functions of the above-described embodiment. For this purpose, the program is provided to the computer for example via a network or from a recording medium of various types serving as the memory device (e.g., computer-readable medium).

This application claims the benefit of Japanese Patent Application No. 2011-193131, filed Sep. 5, 2011, which is hereby incorporated by reference herein in its entirety.

What is claimed is:

1. An image bearing member drive unit that drivingly controls an image bearing member which bears a toner image, comprising:

a drive motor configured to drive the image bearing member;

a speed detection unit configured to detect a speed of the image bearing member;

a first control unit configured to control drive current for said drive motor according to the speed detected by said speed detection unit and a target speed; and a second control unit configured to generate current in a direction opposite to a direction of the drive current when a short brake signal for braking said drive motor is on.

2. The image bearing member drive unit according to claim 1, wherein said drive motor is a brushless DC motor having a plurality of phases, the image bearing member drive unit further comprising a position detection unit configured to detect a rotational position of a rotor of said drive motor, and wherein said first control unit controls energization timing of drive current caused to flow through each phase of said drive motor according to the rotational position detected by said position detection unit.

3. The image bearing member drive unit according to claim 1, wherein said first control unit controls the drive current according to a period and a duty factor dependent on a difference between the detected speed and the target speed.

4. The image bearing member drive unit according to claim 1, further comprising:

a determination unit configured to determine whether or not the speed is within a predetermined range with respect to the target speed; and a generation unit configured to be operable when it is determined by said determination unit that the speed is within a predetermined range with respect to the target speed, to generate the short brake signal which repeats on and off at a predetermined period, or at the predetermined period and at a predetermined duty factor, according to the target speed.

5. The image bearing member drive unit according to claim 4, wherein when the short brake signal is off, said first control unit controls the drive current for said drive motor, according to the detected speed and the target speed.

6. An image forming apparatus including an image bearing member for bearing a toner image, a transfer unit configured to transfer the toner image formed on the image bearing member onto a recording sheet, and an image bearing member drive unit for drivingly controlling the image bearing member, wherein the image bearing member drive unit comprises:

a drive motor configured to drive the image bearing member;

a speed detection unit configured to detect a speed of the image bearing member;

a first control unit configured to control drive current for said drive motor according to the speed detected by said speed detection unit and a target speed; and a second control unit configured to generate current in a direction opposite to a direction of the drive current for said drive motor when a short brake signal for braking said drive motor is on.

7. A method of controlling an image bearing member drive unit that drivingly controls an image bearing member which bears a toner image, comprising:

detecting a speed of the image bearing member driven by a drive motor;

controlling drive current for the drive motor according to the detected speed and a target speed; and generating current in a direction opposite to a direction of the drive current when a short brake signal for braking the drive motor is on.

8. A non-transitory computer-readable storage medium storing a computer-executable program for causing a computer to execute a method of controlling an image bearing member drive unit that drivingly controls an image bearing member which bears a toner image, wherein the method comprises:

detecting a speed of the image bearing member driven by a drive motor;

controlling drive current for the drive motor according to the detected speed and a target speed; and generating current in a direction opposite to a direction of the drive current when a short brake signal for braking the drive motor is on.

* * * * *